US008065986B2

(12) United States Patent
Sachdev et al.

(10) Patent No.: US 8,065,986 B2
(45) Date of Patent: Nov. 29, 2011

(54) PRE-LUBRICATION OF AN INTERNAL COMBUSTION ENGINE BASED UPON LIKELY VEHICLE USAGE

(75) Inventors: Anil K. Sachdev, Rochester Hills, MI (US); Mark W. Verbrugge, Troy, MI (US); Thomas A. Perry, Bruce Township, MI (US); Edward P. Becker, Brighton, MI (US); Emerson J. Adams, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 686 days.

(21) Appl. No.: 12/179,800

(22) Filed: Jul. 25, 2008

(65) Prior Publication Data

US 2010/0018805 A1 Jan. 28, 2010

(51) Int. Cl.
*F01M 1/02* (2006.01)
*F01M 11/10* (2006.01)

(52) U.S. Cl. ..... 123/196 R; 123/196 S

(58) Field of Classification Search ..... 123/196 R, 123/196 S, 196 M; 184/6.1, 6.2, 6.3, 6.4, 184/6.5
See application file for complete search history.

(56) References Cited

U.S. PATENT DOCUMENTS

| | | | |
|---|---|---|---|
| 5,121,720 | A | 6/1992 | Roberts |
| 5,655,495 | A | 8/1997 | Richards |
| 5,743,231 | A | 4/1998 | Reinosa |
| 6,029,621 | A | 2/2000 | Berels |
| 6,349,692 | B1 | 2/2002 | Reinosa |
| 6,655,342 | B1 | 12/2003 | Wendels et al. |
| 2007/0074697 | A1 | 4/2007 | Nielsen |

FOREIGN PATENT DOCUMENTS

WO WO 99/20875 * 4/1999

* cited by examiner

*Primary Examiner* — Noah Kamen

(57) ABSTRACT

A method is disclosed for initiating oil injection into a cylinder of an internal combustion engine prior to engine start-up, the oil injection protecting the engine from damage caused by insufficient lubrication during the start-up. The method includes processing data to modulate a lubrication initiation modifier and initiating the oil injection on the basis of the lubrication initiation modifier.

18 Claims, 4 Drawing Sheets

PRE-LUBRICATION OF AN INTERNAL COMBUSTION ENGINE BASED UPON LIKELY VEHICLE USAGE

TECHNICAL FIELD

This disclosure is related to controlling lubrication of an internal combustion engine.

BACKGROUND

The statements in this section merely provide background information related to the present disclosure and may not constitute prior art.

An internal combustion engine is a complex mechanism involving a great number of mechanical, moving parts subject to high speeds, high temperatures, forces of large magnitude, fatigue, friction, contamination, and corrosion. Lubrication through the circulation and application of oil within the engine is well known in the art as a means to reduce wear by friction, reduce heat, and remove contaminants from particular surfaces. Under normal engine operation, internal combustion engines of various configurations and fuel types utilize an oil pump to circulate and distribute oil from an oil collection area or an oil pan through an oil channeling system to critical areas, such as engine bearings, cylinders, and head valve mechanisms. However, the oil pump does not operate when the engine is turned off.

Gravity acts upon oil in an engine. Oil which was distributed during the last operating cycle is slowly pulled by gravity through the engine into the oil pan, leaving engine surfaces exposed and insufficiently lubricated. While engine start-up activates the oil pump, and oil begins to circulate through the engine again, engine start-up involves a period of time in which the components of the engine operate with little or no oil present. Under ideal conditions, this oil-starved period is short, and the engine operates at idle conditions, reducing the wear on the engine. However, under non-ideal conditions, significant damage to the engine can result. One example of non-ideal conditions includes cold environmental conditions. Oil increases internal frictional forces or viscosity in cold temperatures and becomes thickened. Oil containing contaminants can also become thickened. Thickened oil takes longer for the oil pump to move through the oil channeling system, increasing the period in which damage is done to the engine. Another example of non-ideal conditions includes start-ups followed by immediate operator demand for engine output. If an operator starts and engine and immediately applies pedal input to move the vehicle, the increased forces applied within the engine as a result of the pedal input in the absence of proper lubrication can drastically increase wear upon engine components. Another example of non-ideal conditions includes dealer staging operations, in which unsold vehicles are moved around a dealer's lot with great frequency, sometimes involving a multitude of brief engine starts wherein the vehicle only moved slightly, but each start-up can include operation without proper lubrication. Any of these non-ideal conditions can increase wear upon the engine components and cause maintenance issues.

Methods are known to pre-lubricate an engine by injecting oil onto critical engine parts before operation. Methods are known whereby an electric oil pump, frequently an auxiliary oil pump to the main oil pump, is activated to distribute oil prior to engine start-up. One method to initiate pre-lubrication is to activate the electric oil pump on a timer or upon a control signal of some programmed frequency. This method is effective to pre-lubricate the engine, however the periodic activation of the electric oil pump can create a significant drain upon the battery of the vehicle, creating or exacerbating parasitic drain issues. Additionally, the actual protection created by timed pre-lubrication can be dependent upon how recently the last injection occurred before the start-up event. Another method to initiate pre-lubrication is to accept a keyed ignition request from an operator but delay actual engine start-up briefly while the electric oil pump is activated. This method is effective in pre-lubricating the engine, but the delay imposed upon the operator may be a source of dissatisfaction with the operator. Another method to initiate pre-lubrication includes activating the electric oil pump upon a signal from a keyless entry system, typically by a key fob radio frequency device. This method can be effective but is dependent upon the time elapsed between the keyless entry command and the engine ignition, and additionally is ineffective where the operator has not locked the vehicle, such as in a garage.

SUMMARY

A method for initiating oil injection into a cylinder of an internal combustion engine prior to engine start-up to protect the engine from damage caused by insufficient lubrication during the start-up includes processing data to modulate a lubrication initiation modifier and initiating the oil injection on the basis of the lubrication initiation modifier.

BRIEF DESCRIPTION OF THE DRAWINGS

One or more embodiments will now be described, by way of example, with reference to the accompanying drawings, in which.

DETAILED DESCRIPTION

Figure 1:
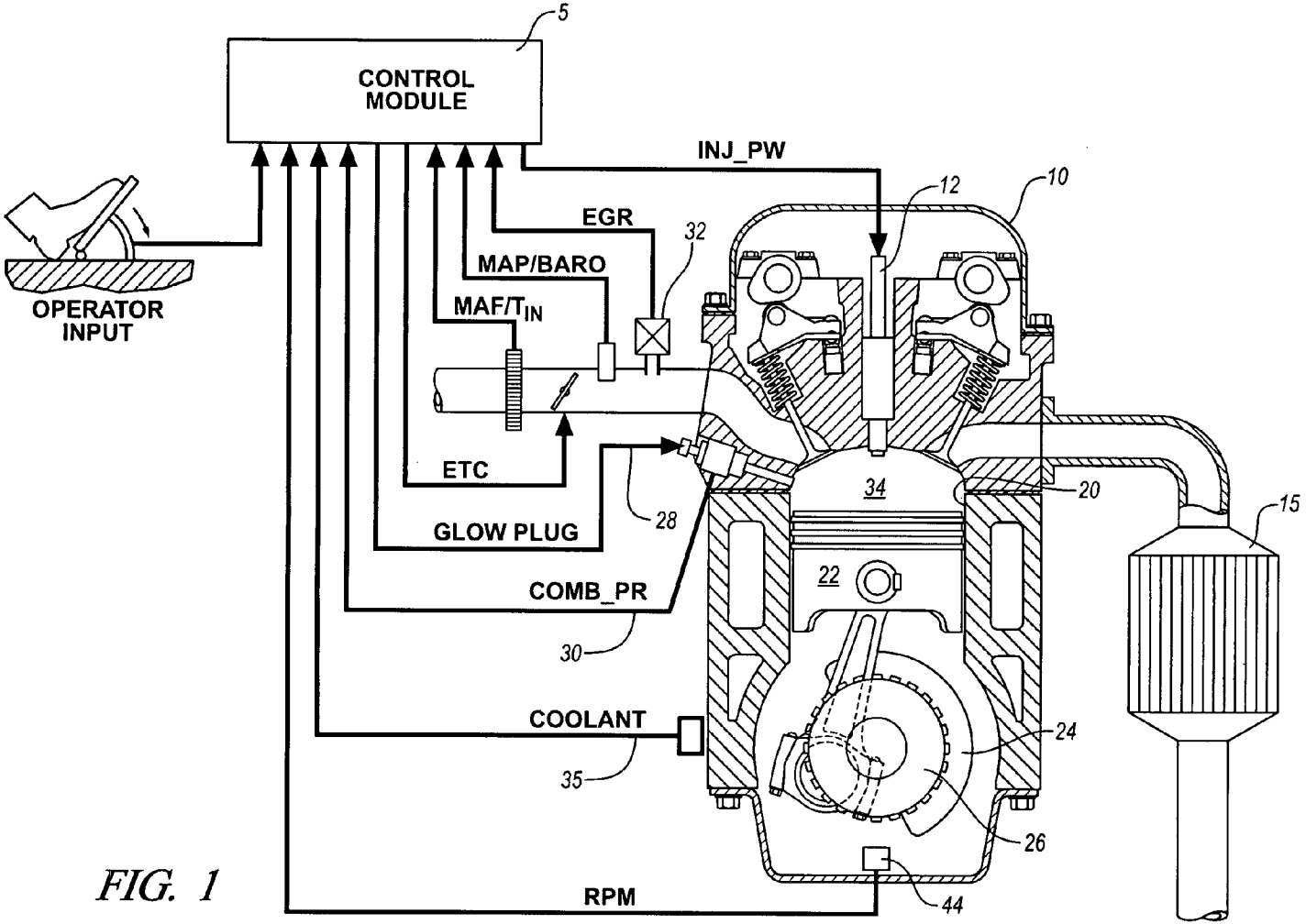
FIG. 1 is a schematic diagram depicting an internal combustion engine and control module constructed in accordance with the present disclosure.

Referring now to the drawings, wherein the showings are for the purpose of illustrating certain exemplary embodiments only and not for the purpose of limiting the same, FIG. 1 is a schematic diagram depicting an internal combustion engine 10 and control module 5, and exhaust aftertreatment system 15, constructed in accordance with an embodiment of the disclosure. The exemplary engine comprises a multi-cylinder internal combustion engine having reciprocating pistons 22 attached to a crankshaft 24 and movable in cylinders 20 which define variable volume combustion chambers 34. The crankshaft 24 is operably attached to a vehicle transmission and driveline to deliver tractive torque thereto. The engine preferably employs a four-stroke operation wherein each engine combustion cycle comprises 720 degrees of angular rotation of crankshaft 24 divided into four 180-degree stages of intake-compression-expansion-exhaust, which are descriptive of reciprocating movement of the piston 22 in the engine cylinder 20. The engine includes sensing devices to monitor engine operation, and actuators which control engine operation. The sensing devices and actuators are signally or operatively connected to control module 5. The piston 22 reciprocates in repetitive cycles each cycle comprising intake, compression, expansion, and exhaust strokes.

Sensing devices are installed on or near the engine to monitor physical characteristics and generate signals which are correlatable to engine and ambient parameters. The sensing devices include a crankshaft rotation sensor, comprising a crank sensor 44 for monitoring crankshaft speed (RPM) through sensing edges on the teeth of the multi-tooth target wheel 26. The crank sensor is known, and may comprise, e.g., a Hall-effect sensor, an inductive sensor, or a magnetoresistive sensor. Signal output from the crank sensor 44 (RPM) is input to the control module 5. There is a combustion pressure sensor 30, comprising a pressure sensing device adapted to monitor in-cylinder pressure (COMB_PR). The combustion pressure sensor 30 preferably comprises a non-intrusive device comprising a force transducer having an annular cross-section that is adapted to be installed into the cylinder head at an opening for a glow-plug 28. The combustion pressure sensor 30 is installed in conjunction with the glow-plug 28, with combustion pressure mechanically transmitted through the glow-plug to the sensor 30. The output signal of the sensing element of sensor 30 is proportional to cylinder pressure. The sensing element of sensor 30 comprises a piezoceramic or other device adaptable as such. Other sensing devices preferably include a manifold pressure sensor for monitoring manifold pressure (MAP) and ambient barometric pressure (BARO), a mass air flow sensor for monitoring intake mass air flow (MAF) and intake air temperature ($T_{IN}$), and, a coolant sensor 35 (COOLANT). The system may include an exhaust gas sensor (not shown) for monitoring states of one or more exhaust gas parameters, e.g., temperature, air/fuel ratio, and constituents. One having ordinary skill in the art understands that there may other sensing devices and methods for purposes of control and diagnostics. The engine is preferably equipped with other sensors (not shown) for monitoring operation and for purposes of system control. Each of the sensing devices is signally connected to the control module 5 to provide signal information which is transformed by the control module to information representative of the respective monitored parameter. It is understood that this configuration is illustrative, not restrictive, including the various sensing devices being replaceable with functionally equivalent devices.

The actuators are installed on the engine and controlled by the control module 5 in response to operator inputs to achieve various performance goals. Actuators include an electronically-controlled throttle device which controls throttle opening to a commanded input (ETC), and a plurality of fuel injectors 12 for directly injecting fuel into each of the combustion chambers in response to a commanded input controlled in response to the operator torque request. There is an exhaust gas recirculation valve 32 and cooler (not shown), which controls flow of externally recirculated exhaust gas to the engine intake, in response to a control signal (EGR) from the control module. The glow-plug 28 comprises a known device, installed in each of the combustion chambers, adapted for use with the combustion pressure sensor 30.

The fuel injector 12 is an element of a fuel injection system, which comprises a plurality of high-pressure fuel injector devices each adapted to directly inject a fuel charge, comprising a mass of fuel, into one of the combustion chambers in response to the command signal from the control module. All of the fuel injectors 12 are supplied pressurized fuel from a fuel distribution system (not shown), and have operating characteristics including a minimum pulsewidth and an associated minimum controllable fuel flow rate, and a maximum fuel flowrate.

The control module 5 is preferably a general-purpose digital computer generally comprising a microprocessor or central processing unit, storage mediums comprising non-volatile memory including read only memory (ROM) and electrically programmable read only memory (EPROM), random access memory (RAM), a high speed clock, analog to digital (A/D) and digital to analog (D/A) circuitry, and input/output circuitry and devices (I/O) and appropriate signal conditioning and buffer circuitry. The control module has a set of control algorithms, comprising resident program instructions and calibrations stored in the non-volatile memory and executed to provide the respective functions of each computer. The algorithms are typically executed during preset loop cycles such that each algorithm is executed at least once each loop cycle. Algorithms are executed by the central processing unit and are operable to monitor inputs from the aforementioned sensing devices and execute control and diagnostic routines to control operation of the actuators, using preset calibrations. Loop cycles are typically executed at regular intervals, for example each 3.125, 6.25, 12.5, 25 and 100 milliseconds during ongoing engine and vehicle operation. Alternatively, algorithms may be executed in response to occurrence of an event.

The control module 5 executes algorithmic code stored therein to control the aforementioned actuators to control engine operation, including throttle position, fuel injection mass and timing, EGR valve position to control flow of recirculated exhaust gases, glow-plug operation, and control of intake and/or exhaust valve timing, phasing, and lift, on systems so equipped. The control module is adapted to receive input signals from the operator (e.g., a throttle pedal position and a brake pedal position) to determine the operator torque request and from the sensors indicating the engine speed (RPM) and intake air temperature ($T_{IN}$), and coolant temperature and other ambient conditions.

The exemplary engine configuration described in FIG. 1 is given for illustrative purposes only to describe the general operation of internal combustion engines. Methods described herein to pre-lubricate cylinders can be used in a wide variety of engine configurations and engine types, and the disclosure is not intended to be limited to the particular embodiments described herein.

Figure 2:
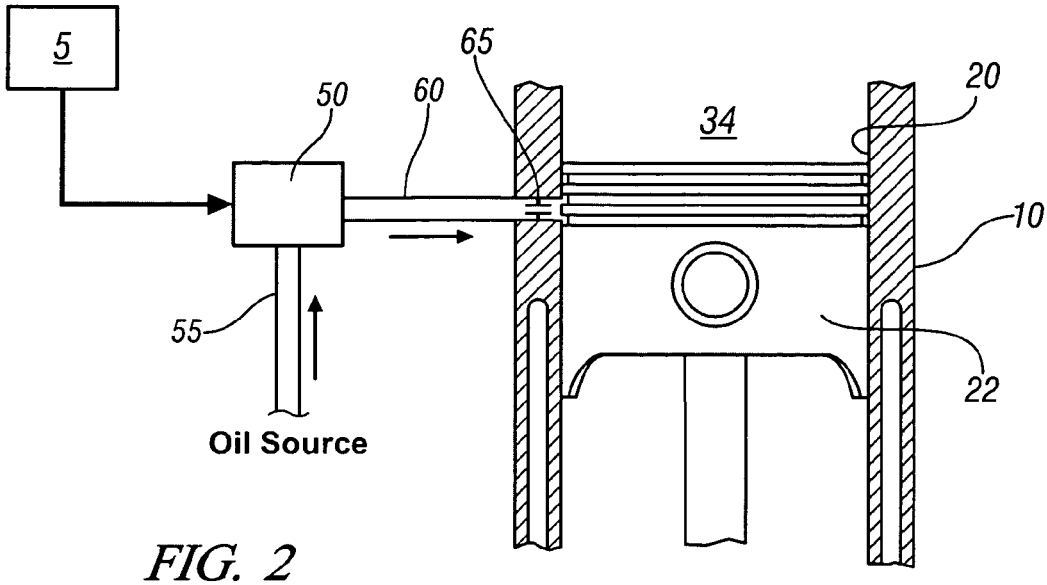
FIG. 2 illustrates an exemplary method to provide pre-lubrication to a cylinder in accordance with the present disclosure.

FIG. 2 illustrates an exemplary method to provide pre-lubrication to a cylinder in accordance with the disclosure. In this exemplary embodiment, engine 10 includes control module 5, cylinder 20, piston 22, and electric oil pump 50. As described above, piston 22 translates within cylinder 20 and is acted upon by fuel air combustion within combustion chamber 34 of cylinder 20. Piston 22 experiences highly cyclical forces, large temperature gradients, and combustion by-products in form of combustion deposits. As described above, oil supplied during normal operation can be absent or present in insufficient quantities during start-up. Oil supply line 60 is depicted penetrating the wall of cylinder 20 in a location where the oil supply line can inject oil into the cylinder proximately to piston 22. Electric oil pump 50 is operably connected to oil feed line 60, allowing electric oil pump 50, when activated by control module 5, to supply oil on demand to cylinder 20 regardless of the operating state of engine 10. In one embodiment, oil feed line 60 injects oil into cylinder 20 below the lowest ring of the ring pack of piston 22 at bottom dead center position, and any spray or distribution effect utilized in cylinder 20 from any location focuses the resulting oil on the walls of cylinder 20 below the rings of piston 22 at top dead center. It will be appreciated by those having ordinary skill in that art that it is preferable that oil not be injected above the piston top dead center position into the combustion chamber 34. Another embodiment includes an oil injector with a hole/nozzle canted upwards so that lubrication can be supplied for the cylinders which are at top dead center. By canting the nozzles upwards, the oil can be squirted various heights above the nozzle into cylinder walls just below the piston, so that, when the piston is moved during the next start-up event, this oil can be propagated through the range of the piston stroke. An embodiment in "V" engines can insert the oil on the valley side of the engine, where one having ordinary skill in the art will recognize the valley side being defined as the side of a cylinder between the intersecting cylinders forming the V. Electric oil pump 50 is connected to control module 5, which can either directly supply power to the pump or may alternatively activate the pump separately connected to a power source with a control signal. Power sources for the electric oil pump 50 can include the vehicle's power system deriving power from the vehicle battery or power sources such as an engine block heating device deriving power from a plug-in unit. Electric oil pump 50 is connected to oil supply line 55 which has access to a supply of oil, such as an oil reservoir or the oil pan. Oil injected into the cylinder can be distributed in a number of ways. The exemplary embodiment of FIG. 2 includes a nozzle device 65 creating a spray pattern, allowing injected oil to cover most or all of the interior surfaces of cylinder 20. Those having ordinary skill in the art will appreciate that particular spray patterns and quantities may take many forms and the various embodiments possible will not be disclosed in detail herein. Also, those having ordinary skill in the art will appreciate that a type of check valve will be needed so combustion gases do not enter the auxiliary pre-oiler system through the nozzle device 65 and oil feed line 60. Additionally, use of a sensor to monitor oil flow through oil supply line 55 or nozzle device 65 is envisioned, enabling use of a start-up delay until actual oil flow commences. Start-up delay as used herein may include delay of mechanical engine cranking, delay of fuel and spark delivery during cranking or a combination thereof.

FIG. 2 as previously described illustrates a method whereby pre-lubrication can be accomplished through a nozzle device 65 penetrating the wall of cylinder 20 proximately to piston 22. Other locations of oil delivery can be used depending on the engine design, including spraying oil from the bottom of the oil sump onto the cylinder walls or using known oil squirters with or without modification. In a configuration spraying from the bottom of the oil sump, an electric oil pump with access to a supply of oil is operably connected to an oil feed line equipped with a nozzle device, allowing the electric oil pump, when activated by a control module, to spray oil on demand onto the walls of the cylinder. The nozzle device is positioned to spray the oil onto the area under the piston, such that when the piston is subsequently moved, the translation of the piston along the walls of the cylinder propagates oil through the length of the stroke of the piston. The configuration of the nozzle to the cylinder and the piston are not important so long as the resulting injection of oil is operative to lubricate the area on the cylinder walls through the piston stroke. Particular embodiments can include a local heating system to thin the oil when the oil pump is not running. Many embodiments of particular methods to inject oil into the cylinder are contemplated, and this disclosure is not intended to be limited to the particular embodiments described herein.

On-board processing or processing by computational resources in the vehicle of vehicle operation enables control of pre-lubrication on the basis of vehicle history and operator specific history. For example, pre-lubrication control can be modulated based upon certain parameters, such as but not limited to: ambient temperature; engine temperature measured by coolant temperature; oil temperature; contamination of the oil estimated by the span since the last oil change; contamination of the oil by water and fuel contamination, estimated, for example, by analysis of short-trip driving patterns that fail to purge the oil of contaminants typically boiled off; engine mileage; estimated state of engine wear based upon analysis of engine metrics such as efficiency and exhaust content; time since last operating cycle ended; and oil weight (5W30 versus 10W40, for example). An algorithm can be utilized to estimate the effects of these factors upon the state of the engine at the next start-up event and the incremental damage that is likely to occur. Depending upon the perceived risk to the engine, control module 5 modulates the initiation or implementation of pre-start-up injections to compensate and avoid engine damage. For instance, control module 5 can command pre-lubrication events, modulate the amount of oil injected during the next start-up event, or command a delay during the next ignition cycle to allow adequate pre-lubrication based upon the aforementioned factors. Additionally, vehicle specific operating patterns can be utilized to command pre-lubrication event, for example in accordance with a recognized calendar day pattern based on vehicle starting history. For example, if control module 5 analyzes start-up data through an algorithm and determines that the vehicle is started certain weekdays within a certain time span, the algorithm can command a pre-lubrication event thirty minutes before this time span, thereby reducing the engine wear incurred during these start-ups. Similarly, if control module 5 determines that start-ups in the afternoon occur at varying times and involve very short warm up times, the algorithm of control module 5 can command sporadic pre-lubrication events to compensate for this perceived trend. In another example, a vehicle could be programmed with an initial setting indicating that the vehicle had not yet been delivered to the customer. Under this pre-delivery or unsold vehicle status setting, the vehicle could operate under a protective pre-lubrication scheme, with more frequent timed pre-lubrication events and with programmed ignition delays to allow for oil injection into cylinder 20 in the event of an ignition command. Such protective measures could be implemented incrementally or could be part of a unified protection mode. Additionally, command module 5 can adjust for perceived opportunities, such as the vehicle receiving power from an engine block heating device, and utilize the power source by pre-lubricating in instances where, under battery power, pre-lubrication might not be initiated to conserve battery power. It should be appreciated by those having ordinary skill in the art that the application of the aforementioned factors to the control of pre-lubrication events can have a multitude of embodiments and usages, and the disclosure is not intended to be limited to the specific examples described herein.

Figure 3:
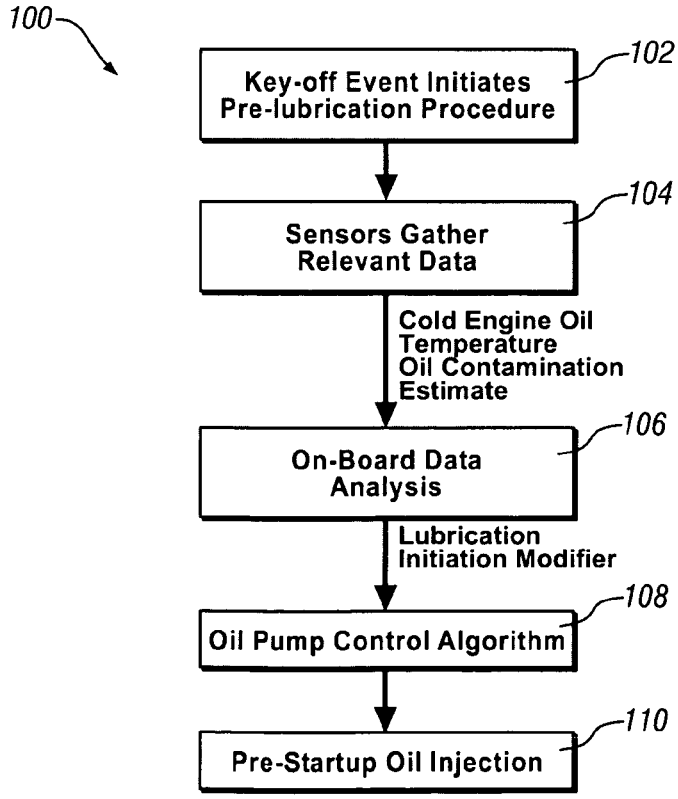
FIG. 3 describes an exemplary method whereby on-board processing utilizes factors regarding a vehicle to control pre-lubrication in accordance with the present disclosure.

FIG. 3 illustrates process 100 describing an exemplary method whereby on-board processing utilizes factors regarding the vehicle to control pre-lubrication in accordance with the disclosure. In step 102, a key-off event, ending the previous operating cycle for the vehicle, initiates the pre-lubrication procedure. In step 104, sensors on-board the vehicle gather data related to oil behavior. In the particular embodiment illustrated in FIG. 3, cold-engine oil temperature and an oil contamination estimate based upon duration since the last oil change are described; however, as described above, the particular data gathered can take many embodiments and combinations. In step 106, a processor analyzes the collected data, calculates a lubrication risk factor and determines a lubrication initiation modifier to indicate parameters for oil injection necessary to protect the engine from wear. In essence, if the risk factor exceeds a predetermined threshold, oil injection is warranted prior to engine start-up. This modifier is used in the oil pump control algorithm in step 108 to implement oil pump control logic. Control logic developed in step 108 is used to complete the process with implementation of oil injection into the cylinder in step 110.

Wireless communication and satellite telemetry devices enable methods of pre-lubrication control requiring detailed location information. For example, weather reports can be downloaded through wireless communication devices and lubrication initiation modifiers can be adjusted to compensate for the reported temperatures in the area of the vehicle. The region in which the vehicle is operating can additionally be taken into account, for example, if the vehicle is operating near a coastline where increased humidity is likely or in a desert where sand contamination is likely, lubrication initiation modifiers can be adjusted to compensate for the effects upon engine wear and oil behavior. Location specific information can be utilized to modulate pre-lubrication parameters. For example, a vehicle tracked by GPS to be in a dealer's lot or operated in a certain manner consistent with dealer staging operations may be assumed to be in a dealer's inventory and is subject to deal staging operations as described above. Similarly, a vehicle tracked by GPS to be in a rental lot or at an operator's known place of work might be subject to particular driving patterns, and lubrication initiation modifiers can be adjusted to compensate. Alternatively, a control module can utilize the behavior of cellular tower signals, radio tower signals, or other signals capable of analysis to estimate location and likely operating behavior.

Figure 4:
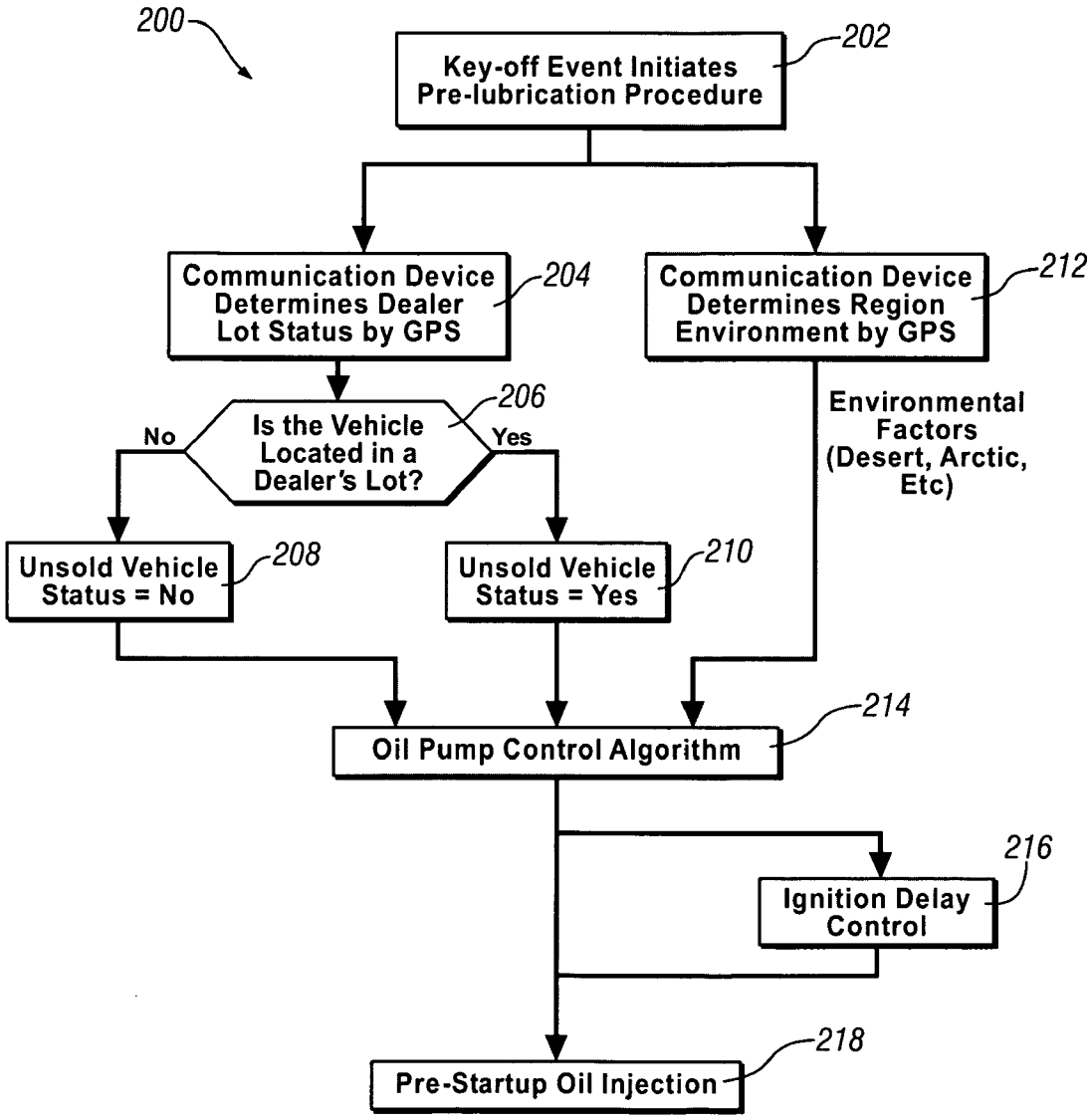
FIG. 4 describes an exemplary method whereby a control module may utilize communication or location telemetry information regarding a vehicle to control pre-lubrication in accordance with the present disclosure.

FIG. 4 illustrates process 200 describing an exemplary method whereby a control module may utilize communication or location telemetry information regarding the vehicle to control pre-lubrication in accordance with the disclosure. In step 202, a key-off event, ending the previous operating cycle for the vehicle, initiates the pre-lubrication procedure. As aforementioned, various types of information are available for use in the methods described herein, and the use of any of the information mentioned in the disclosure may be combined for use in evaluating vehicle conditions. The particular embodiment illustrated in FIG. 4 makes use of two distinct types of information available through communications devices: namely, GPS location data in conjunction with known dealership locations and regional environmental classifications available according to GPS location. Steps 204 through 210 detail determination of unsold vehicle status by GPS location in accordance with the disclosure. At step 204, a communications device acquires information regarding the vehicle location and cross-referenced known dealership location information. One having ordinary skill in the art will recognize that locating retail establishments by GPS location is well known, and the details of this process will not be disclosed in detail herein. At step 206, a determination is made whether the vehicle is located on a dealership parking lot. If the vehicle is not determined to be located on a dealership parking lot, the unsold vehicle status is set to "no" at step 208. If the vehicle is determined to be located on a dealership parking lot, the unsold vehicle status is set to "yes" at step 210. Information regarding unsold vehicle status is relayed to the oil pump control algorithm at step 214 for use in implementing oil pump control logic. Step 212 details determination of regional environmental classification by GPS location in accordance with the disclosure. One having ordinary skill in the art will recognize that determining regional environmental classification of an area, such as desert, mountains, or urban areas, by GPS location is well known in the art, and the details of this process will not be disclosed in detail herein. The environmental classification developed in step 212 is relayed to the oil pump control algorithm at step 214 for use in implementing oil pump control logic. In step 214, a processor analyzes available data and determines a lubrication initiation modifier to indicate parameters for oil injection necessary to protect the engine from wear. This modifier is used in the oil pump control algorithm in step 214 to implement oil pump control logic. Control logic developed in step 214 is used to interrupt ignition control at step 216 to implement keyed ignition delay when appropriate and to complete the process with implementation of oil injection into the cylinder at step 218.

Remote processing of vehicle operation and communication with the vehicle enables pre-lubrication on the basis of a number of factors. Factors available from the vehicle and from location data can be coordinated and analyzed by remote processing to command and modulate pre-lubrication events. For instance, in order to avoid aforementioned wear associated with dealer staging, a remote processing system can look for large numbers of similar vehicles parked in a single lot or look for particular configurations of vehicle parking indicative of dealer lots and adjust pre-lubrication schemes as discussed above to mitigate driving behaviors inherent to dealer staging. Remote processing in this manner also allows for complex analyses to be performed and updated by control of the remote algorithm. For instance, emission controls, alternative fuels, and regulation of additives create changes in oil and fuel products made available to the consumer. Changes in composition to oil or fuel could have impacts to the vehicle unforeseen at the time of vehicle manufacture, and analysis and control by remote algorithms of pre-lubrication events can be utilized to compensate for such changes.

Additionally, remote processing in communication with the vehicle allows the tracking of registered operators across vehicles in communication with the remote processing. For instance, a vehicle owner, registered for his own vehicle and tracked for any of a number of unrelated functions, such as GPS map functions, radio preferences, and seat positions, can at the same time be monitored for habitual behaviors such as vehicle start-up times and likely vehicle warm up times. When the registered operator utilizes another vehicle, for example, by renting a vehicle on vacation, the remote system can adjust the pre-lubrication behaviors for the particular operator. Additionally, an operator can create a profile on the remote system regarding operating preferences. For example, an operator concerned about engine wear and unbothered by a delayed ignition cycle can program pre-lubrication for vehicles used by that particular operator. Identification of a registered operator can be accomplished by many methods known in the art, including a unique identifying device embodied in such devices as a key, a key chain, a keyless entry device, or an ID card; voluntary operator identification through a driver interface device asking for such information as a name or an I.D. number; biometric identification through such methods as fingerprinting or retinal scans; or other methods known in the art to identify a particular person.

Figure 5:
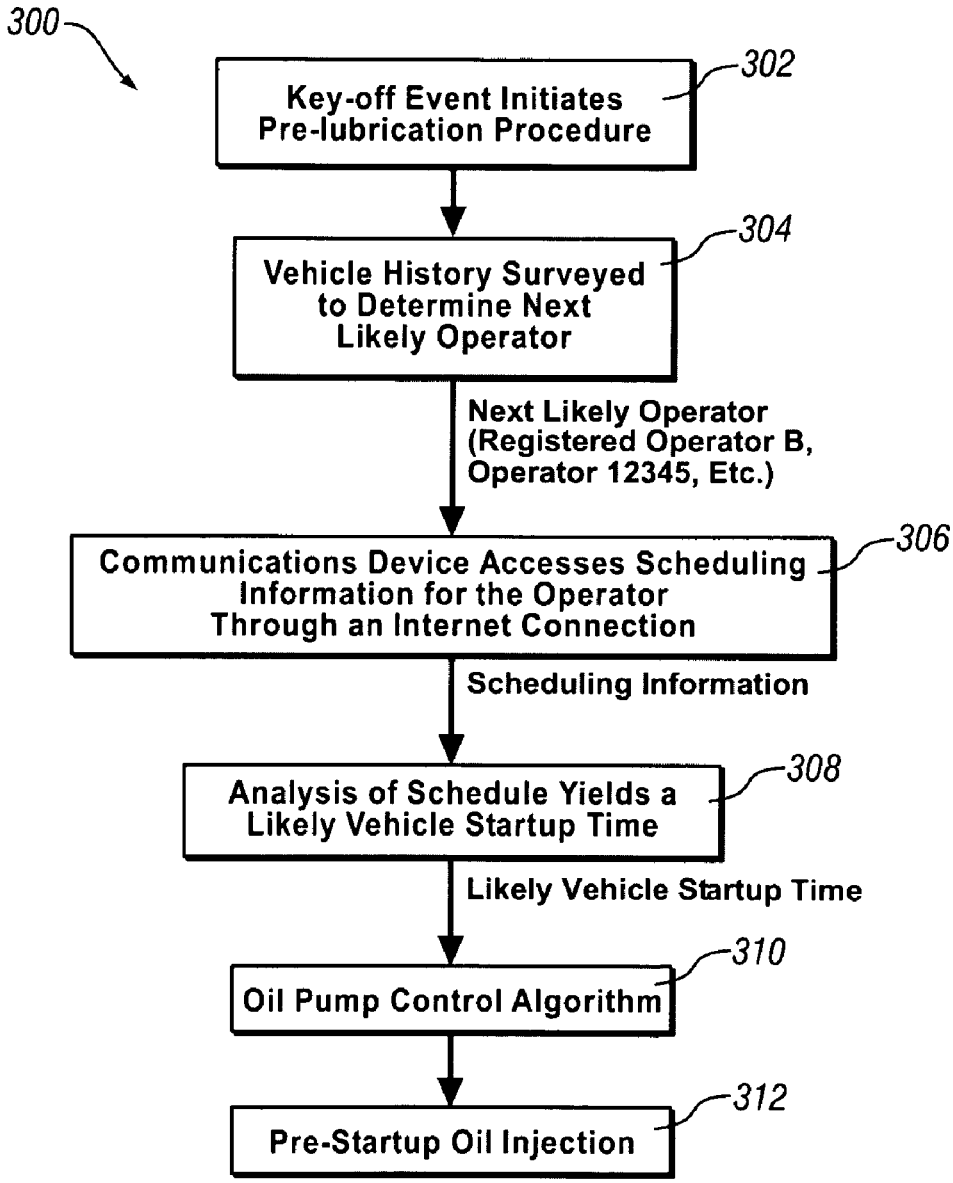
FIG. 5 describes an exemplary method whereby remote processing is utilized to process information regarding a vehicle to control pre-lubrication in accordance with the present disclosure.

FIG. 5 illustrates process 300 describing an exemplary method whereby remote processing is utilized to process information regarding the vehicle to control pre-lubrication in accordance with the disclosure. In step 302, a key-off event, ending the previous operating cycle for the vehicle, initiates the pre-lubrication procedure. In step 304, an on-board processor reviews vehicle operation history and information available regarding operator identity, available from methods describe above, and the processor estimates a next likely operator. For instance, a pattern might exist that of three registered operators that typically use the vehicle, identified by distinct radio chip enabled key chains, registered operator B tends to use the vehicle on Wednesday mornings. Once the next likely operator is identified, a communications device in step 306 accesses scheduling information for the operator such as through an internet connection or other communication networking means (e.g. Bluetooth, etc.). Scheduling information may be accessed from many sources including remote or on-vehicle software applications and portable devices containing electronic schedules or calendars or vehicle operation pattern analysis. Once scheduling information has been accessed, an analysis is performed upon the information in step 308 to develop a likely vehicle start time. A processor utilizes the likely vehicle start time to determine a lubrication initiation modifier, for instance by determining a pre-start-up lubrication time or by modulating a periodic oil injection command. The oil pump control algorithm in step 310 then uses the modifier to implement oil pump control logic. Control logic is then used to complete the process with implementation of oil injection into the cylinder in step 312.

Control reactions available to control module 5 to compensate for factors or pre-lubrication requirements are described in detail throughout this disclosure, and include the control module commanding timed oil injections, oil injections at or prior to times of expected start-up, oil injections in response to some impetus, and commanded delays to start-up to allow pre-injection, where necessary. Control module 5 may further modulate commanded oil injections by means described throughout this disclosure including increasing or decreasing amounts or frequency of oil injections, modulating the spray pattern of the oil injected into the engine through either modulation of the voltage applied to electric oil pump 50 or through a controllable nozzle 65, or preheating nozzle 65 to facilitate the application of oil to cylinder 20.

Aforementioned algorithms utilized by control module 5 or by remote systems may take many forms. An algorithm can be programmed with particular parameters and behaviors keyed to specific inputs, such as the inputs from in-vehicle sensors or known available GPS signals, and the algorithm can be programmed to respond with set responses. In the alternative, those having ordinary skill in the art will appreciate that machine learning algorithms utilizing fuzzy logic or neural networks or other adaptive programming can be used to adapt the algorithm to a wide variety of input and vehicle behaviors. The algorithm utilized by control module 5 or by remote systems may take many forms and is not intended to be limited to the specific embodiments described herein.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for initiating oil injection into a cylinder of an internal combustion engine prior to engine start-up, said oil injection protecting said engine from damage caused by insufficient lubrication during said start-up, said method comprising:

processing data comprising a vehicle starting history to predict a likely vehicle start-up time; and commanding a pre-lubrication event at a time span before said likely vehicle start-up time.

2. A method for initiating oil injection into a cylinder of an internal combustion engine prior to engine start-up, said oil injection protecting said engine from damage caused by insufficient lubrication during said start-up, said method comprising:

processing data to modulate a lubrication initiation modifier; and initiating said oil injection on the basis of said lubrication initiation modifier;

wherein said processing data comprises monitoring a schedule of an operator;

wherein said modulating a lubrication initiation modifier comprises determining a likely vehicle start-up time on the basis of said schedule; and wherein initiating said oil injection comprises commanding a pre-lubrication event a time span before said likely vehicle start-up time on the basis of said likely vehicle start-up time.

3. The method of claim 2, wherein said monitoring a schedule comprises accessing an electronic calendar.

4. The method of claim 3, wherein said accessing an electronic calendar comprises communicating over a wireless communications network.

5. The method of claim 2, wherein said monitoring a schedule comprises processing historical patterns of a registered operator.

6. The method of claim 2, wherein said determining a likely vehicle start-up time comprises:

monitoring historical start-up times for said engine; and estimating a calendar day average start-up time on the basis of said historical start-up times.

7. A method for initiating oil injection into a cylinder of an internal combustion engine prior to engine start-up, said oil injection protecting said engine from damage caused by insufficient lubrication during said start-up, said method comprising:

processing data to modulate a lubrication initiation modifier; and initiating said oil injection on the basis of said lubrication initiation modifier;

wherein said processing data comprises monitoring engine lubrication requirement data including at least one of oil temperature, time since last key-off event, duration since last oil change, geographic location, average vehicle start-up idle, oil weight, likely oil composition, likely fuel composition, and pre-sale vehicle status; wherein said modulating a lubrication initiation modifier comprises utilizing said engine lubrication requirement data to calculate a lubrication risk factor; and wherein said initiating on the basis of said lubrication initiation modifier comprises compelling an oil injection event prior to engine start-up if said lubrication risk factor is greater than a threshold lubrication risk factor.

8. The method of claim 7, wherein said compelling an oil injection event prior to engine start-up comprises delaying engine start-up and injecting oil into said cylinder.

9. The method of claim 7, wherein said compelling an oil injection event prior to engine start-up comprises initiating a periodic oil injection event.

10. The method of claim 7, wherein said compelling an oil injection event prior to engine start-up comprises:

monitoring imminent start-up indicators including at least one of keyless entry commands, keyed entry sensors, driver seat weight sensors, driver seatbelt sensors, driver seat position commands, or keyed ignition sensors; and injecting oil on the basis of said monitoring.

11. The method of claim 7, wherein said compelling an oil injection event prior to engine start-up comprises:

processing historical start-up times;

estimating a calendar day average start-up time on the basis of said historical start-up times; and injecting oil at a pre-start-up interval before said calendar day average start-up time.

12. The method of claim 7, wherein presale vehicle status includes vehicle geographic location; and wherein compelling an oil injection event prior to engine start-up comprises utilizing a dealer staging protection mode including at least one of delaying keyed engine start-up to allow injection of oil into said cylinder and initiating a periodic oil injection event.

13. A method for initiating oil injection into a cylinder of an internal combustion engine prior to engine start-up, said oil injection protecting said engine during start-ups before the vehicle is delivered to a consumer, comprising:

monitoring vehicle data to estimate an unsold vehicle status; and injecting oil into said cylinder according to a dealer staging protection mode on the basis of said unsold vehicle status.

14. The method of claim 13, wherein said monitoring vehicle data includes monitoring global positioning data; and wherein said estimating an unsold vehicle status comprises referencing said global positioning data against known dealership location data.

15. The method of claim 13, wherein said monitoring vehicle data includes monitoring vehicle start-up behavior; and wherein said estimating an unsold vehicle status comprises comparing said vehicle start-up behavior to predefined dealer staging behavior.

16. The method of claim 13, wherein said monitoring vehicle data includes monitoring global positioning data; and wherein said estimating an unsold vehicle status comprises comparing said global positioning data to global position data of other vehicles and identifying parking patterns indicating dealer staging behavior.

17. An apparatus for protecting an engine from wear caused by insufficient cylinder lubrication during start-up events comprising:

an electric oil pump controllably injecting oil into a cylinder of said engine;

a control module monitoring data indicating a likely vehicle start-up time and issuing commands to said electric oil pump on the basis of said likely vehicle start-up time wherein said control module monitors data indicating a likely vehicle start-up time by utilizing a communications device transferring data to and from a remote system containing scheduling information for a registered operator of said vehicle.

18. An apparatus for protecting an engine from wear caused by insufficient cylinder lubrication during start-up events comprising:

an electric oil pump controllably injecting oil into a cylinder of said engine;

a control module monitoring data indicating a likely vehicle start-up time and issuing commands to said electric oil pump on the basis of said likely vehicle start-up time wherein said control module monitors data indicating a likely vehicle start-up time by utilizing a communications device transferring data to and from a remote system containing scheduling information for a plurality of registered operators of said vehicle.

* * * * *